United States Patent [19]

Wollman

[11] Patent Number: 4,664,533

[45] Date of Patent: May 12, 1987

[54] WATCH CASE AND BRACELET ASSEMBLY

[75] Inventor: Jack Wollman, Manhasset, N.Y.

[73] Assignee: Bulova Watch Co., Inc., Flushing, N.Y.

[21] Appl. No.: 915,612

[22] Filed: Oct. 6, 1986

[51] Int. Cl.[4] ..... G04B 37/00

[52] U.S. Cl. ..... 368/282; 224/164

[58] Field of Search ..... 368/281–282; 224/164–177, 180

[56] References Cited

U.S. PATENT DOCUMENTS

| | | | |
|---|---|---|---|
| Re. 28,793 | 5/1976 | Bert | 224/164 |
| 2,446,065 | 7/1948 | Starke | 368/282 |
| 3,975,899 | 8/1976 | Haber | 368/282 |
| 4,432,655 | 2/1984 | Wellman | 368/282 |
| 4,564,308 | 1/1986 | Ikegami et al. | 224/164 |

FOREIGN PATENT DOCUMENTS

| | | | |
|---|---|---|---|
| 280560 | 5/1952 | Switzerland | 368/282 |
| 337465 | 5/1959 | Switzerland | 368/282 |
| 380035 | 3/1964 | Switzerland | 368/282 |
| 473421 | 7/1969 | Switzerland | 368/282 |
| 570647 | 7/1975 | Switzerland | 368/282 |

*Primary Examiner*—Vit W. Miska

*Attorney, Agent, or Firm*—Michael Ebert

[57] ABSTRACT

A metal watch case and metal bracelet assembly in which the tail ends of the bracelet components are attachable to the complementary ends of the case in a manner simulating a "soldered look," yet these components may readily be detached to replace the bracelet. The case which is adapted to accommodate the watch movement has straight ends each provided with a longitudinal keyway defined by parallel ridges, one of which has a midpoint gap therein occupied by a projecting tab. Each bracelet component terminates in a split tail pin which is slidable into the keyway at the complementary end of the case and is locked therein by the tab which when bent down extends into the mid space between the half pieces of the pin.

5 Claims, 6 Drawing Figures

Fig. 1.
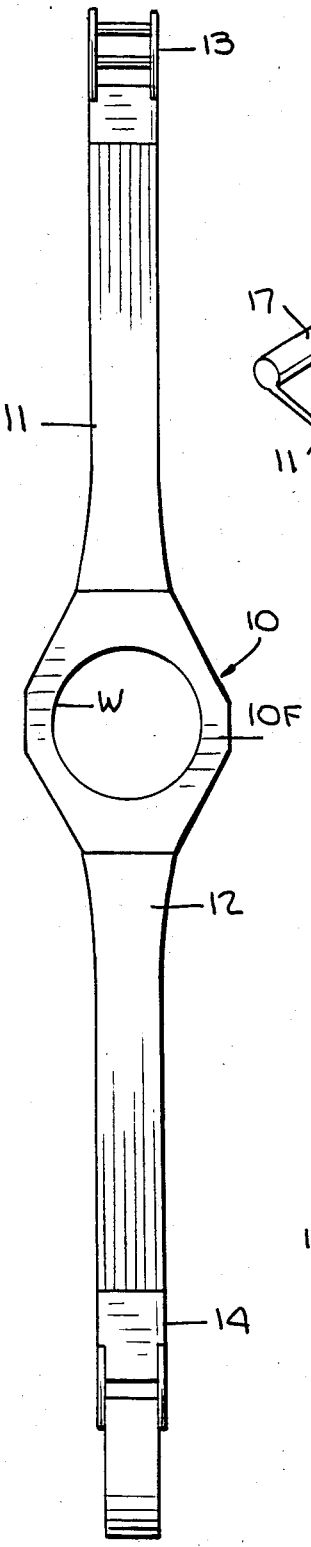
Fig. 3.
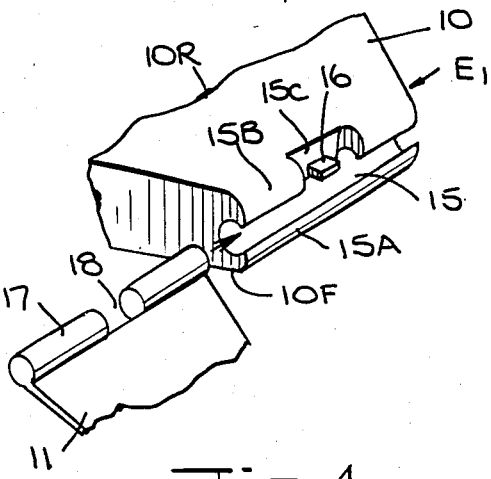
Fig. 4.
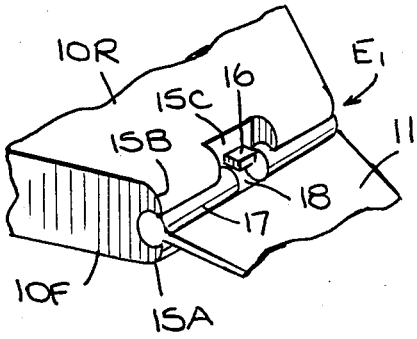
Fig. 5.
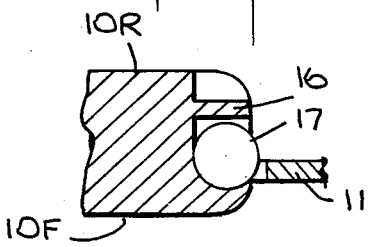
Fig. 6.
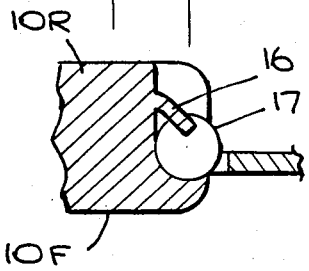
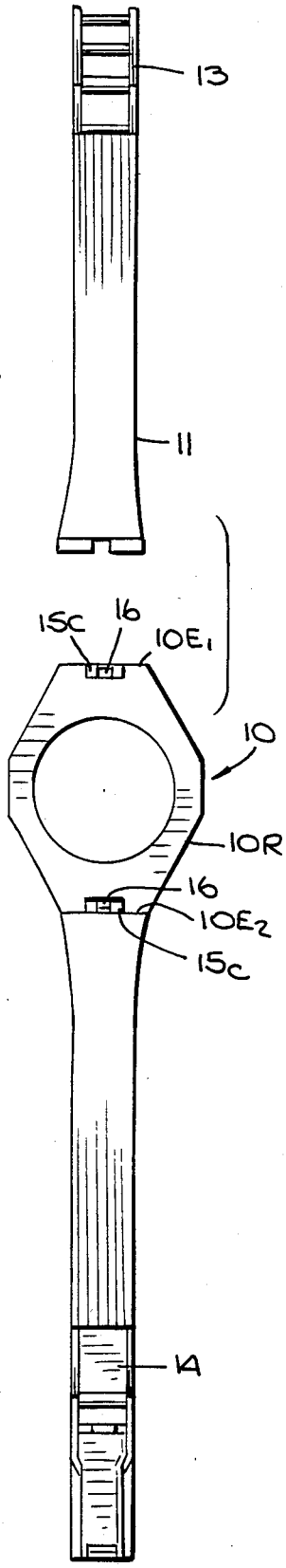
Fig. 2.

WATCH CASE AND BRACELET ASSEMBLY

BACKGROUND OF INVENTION

1. Field of Invention

This invention relates to timekeeping wrist watches, and in particular to a metal watch case and metal bracelet assembly in which the components of the bracelet are linked to the complementary ends of the case in a manner simulating a "soldered look."

2. Status of Prior Art

In conventional modern watches, the timekeeping movement is housed within a metal case provided with a pair of projecting lugs at either end. Each pair of lugs is bridged by a retractable cross bar having spring-biased pins or pintles extending axially therefrom to be received within small cavities formed in the lugs. The watch strap or bracelet associated with the case may be fabricated of leather, plastic, metal or other flexible material, the strap being constituted by two complementary components whose adjacent ends terminate in a buckle, a clasp or other means to join the components together at a position appropriate to the size of the wearer's wrist. The other ends of tails of the strap components are in a looped formation or are provided with a fixture having a transverse bore to admit the cross bar, thereby linking the components to the case.

The conventional case and bracelet arrangement makes it a relatively simple matter to couple or decouple the strap or bracelet components. In order, therefore, to replace a worn bracelet with a fresh bracelet of the same or different design, one need only displace the pintles inwardly with a suitable tool to release the cross bar from the lugs, after which the bars are removed from the worn bracelet component and inserted in the loops or bores of the fresh components which are then linked to the projecting lugs of the case.

From the standpoint of aesthetics or ornamental design, a conventional linked case and bracelet assembly in which the case is provided with opposing pairs of projecting lugs is incompatible with modern design trends. Current design directions reflect the "minimalist" school of art and is toward extreme simplicity and the avoidance of detail. In order, therefore, to create a watch case and bracelet having a severe and uncluttered appearance, it is now the practice with metal bracelets to weld or solder the bracelet components to the ends of a case having no projecting lugs. This simple integration of bracelet and case has an appearance that is often referred in the trade to as the "soldered look."

The "soldered look," though it satisfies modern design trends, has distinct practical drawbacks. If the bracelet is worn or damaged and in need of replacement, or the wearer wishes to replace an existing metal bracelet with a bracelet having a different ornamental appearance, he cannot do so; for the bracelet is permanently integrated with the case. Hence, to replace a damaged bracelet one must first take the watch movement out of the case and insert it into a new integrated case and bracelet combination, even though the case may still be in good condition.

In my prior U.S. Pat. No. 4,432,655, there is disclosed an integrated watch case and metal bracelet assembly in which the components of the bracelet are so linked to the complementary ends of the case as to simulate "a soldered look."

In my patented metal watch case and metal bracelet assembly, the tail ends of the bracelet components are attachable to the complementary ends of the case in a manner simulating a "soldered look," yet these components may readily be detached to replace the bracelet. The case which is adapted to accommodate the watch movement has straight ends each provided with a longitudinal groove, the case having at its midpoint adjacent each end a threaded bore to receive a holding screw which when turned in penetrates the related groove. Each bracelet component terminates in a split tail pin which is slidable into the groove at the complementary end of the case and is locked therein by the holding screw which when turned in extends into the mid space between the half pieces of the pin; hence to detach the component from the case, one has merely to turn out the screw.

An integrated assembly of the type disclosed in my prior patent is somewhat more expensive to manufacture than a watch in which the bracelet is welded or soldered to the case, for the use of a screw requires that a tapped hole be provided therefor. Moreover, while the use of a screw to lock the bracelet to the watch case makes it easy when necessary to replace the bracelet without the need for special tools for this purpose and thereby obviates the need to transfer the movement to a new case as with a soldered bracelet, it also has the usual disadvantages of a screw. Screws tend in time to loosen, and this can happen without the wearer of the watch being aware of this condition. This may result in the detachment of the bracelet from the watch case, and possibly the loss of the watch.

Also of prior art interest are the U.S. Pat. Nos. 2,446,065, to Starke, and Haber, 3,975,899, and the Swiss Pat. Nos. 280,560 (1952), 337,465 (1959), 380,035 (1964) and 473,421 (1969).

SUMMARY OF INVENTION

In view of the foregoing, the main object of this invention is to provide an improved watch case and metal bracelet assembly in which the components of the bracelet are linked to the complementary ends of the case in a manner simulating a "soldered look," the linkage being effected not by a screw but by a bendable tab.

A significant advantage of an integrated case and bracelet assembly in accordance with the invention is that the wearer himself may readily attach or detach the components of the bracelet by bending the tab without the need for special tools for this purpose. A further advantage resides in the fact that an existing bracelet may be replaced with fresh components of the same or different design while retaining the same watch case, thereby obviating the need to transfer the movement to a new case.

Also an object of the invention is to provide a low-cost assembly of the above type in which, as seen from the front face of the watch case, the components of the bracelet appear to be integrated with the case.

Briefly stated, these objects are accomplished by a metal watch case and metal bracelet assembly in which the tail ends of the bracelet components are attachable to the complementary ends of the case in a manner simulating a "soldered look," yet these components may readily be detached to replace the bracelet. The case which is adapted to accommodate the watch movement has straight ends each provided with a longitudinal keyway defined by parallel ridges, one of which has a midpoint gap therein occupied by a projecting tab.

Each bracelet component terminates in a split tail pin which is slidable into the keyway at the complementary end of the case and is locked therein by the tab which when bent down extends into the mid space between the half pieces of the pin.

OUTLINE OF DRAWINGS

For a better understanding of the invention as well as other objects and further features thereof, reference is made to the following detailed description to be read in conjunction with the accompanying drawings, wherein:

FIG. 1 is a plan view, as seen from the front face of an integrated watch case and metal bracelet assembly in accordance with the invention;

FIG. 2 is a plan view, as seen from the rear face of the same assembly, with one of the bracelet components detached from the case;

FIG. 3 illustrates the manner in which the split tail pin of one of the bracelet components slides into the keyway at the complementary end of the watch case;

FIG. 4 is the same as FIG. 3, with the tail pin shown joined to the complementary end of the case;

FIG. 5 is a section showing the relationship of the tail pin to the keyway in the complementary end of the case with the locking tab unbent; and FIG. 6 is the same as FIG. 5 but with the locking tab bent.

DESCRIPTION OF INVENTION

Referring now to FIG. 1, there is shown a watch case and metal bracelet assembly in accordance with the invention which on the visible front face thereof, as worn on the wrist of a user, appears to have a "soldered look." The assembly is comprised of a case 10 having the components 11 and 12 of a metal bracelet linked to the complementary ends of the case. The fact that these components are detachable is not apparent in the front face 10F view.

The leading ends of bracelet components 11 and 12 are provided with complementary clasp elements 13 and 14, respectively, which serve to join the components when they encircle the wrist of the wearer. These elements form no part of the present invention, for other forms of connecting elements may be used for the same purpose. Hence the structure of these elements will not be detailed herein.

As the assembly is seen from the rear face 10R thereof, as shown in FIG. 2, case 10, which has a generally octagonal form with straight ends $10E_1$ and $10E_2$,is provided with a central well W adapted to receive the timekeeping movement of the watch. The shape of the watch case need not be octagonal as long as it has straight ends; hence the sides of the case may be in an arcuate or other formation. And well W need not be circular, as shown but in a shape appropriate to the watch movement placed therein.

Each straight end $10E_1$ and $10E_2$ of case 10, as shown in FIGS. 3 and 4 in connection with end $10E_1$, has a longitudinal keyway 15 extending thereacross. Keyway 15 has a circular cross section and is bordered by parallel ridges 15A and 15B. At the midpoint of ridge 15B is a gap 15C having a bendable tab 16 therein which projects from the case end and normally overlies keyway 15.

The tail of each bracelet component, as illustrated by tail of component 11 in FIG. 3, terminates in a split pin 17 to define a midspace 18 between the two half pieces of the pin. In practice, this split pin is welded to the tail end of the bracelet component so that it is a permanent part thereof. The split pin has a diameter slightly smaller than the internal diameter of keyway 15 in the end of the case, and the pin has a length equal to that of the keyway.

Hence as shown in FIG. 3, one may without difficulty laterally slide spit pin 17 into keyway 15 whereby when the split pin is in place, as shown in FIG. 4, its midspace 18 is then in registration with gap 15C in ridge 15B. In this position, tab 16 then overlies keyway 15.

The initial relationship of tab 16 to the inserted bracelet pin 17 is illustrated in FIG. 5, where it will be seen that the tab is projected above the midspace in pin 17. Tab 16 is formed of the same metal as case 10 and in practice may be made of brass or any other deformable metal. When, therefore, tab 16 is bent down by a screwdriver or any other simple tool, as shown in FIG. 6, it then occupies the midspace in pin 17 and acts as a barrier to prevent removal of the pin. As a consequence, the pin can no longer slide in either direction and is locked in place.

Once the bracelet components are locked into the complementary ends of case 10, the appearance of the assembly, as seen from front face 10F (see FIG. 1), is fully integrated; for the bracelet then appears to be permanently joined to the case, and the assembly has the desired "soldered look." The tab means by which the bracelet components are locked to the case are visible only at the rear of the watch as shown in FIG. 2, and this view is concealed when the watch is worn on the wrist.

The use of a deformable tab rather than a screw to lock in the bracelet provides a greater measure of security, the deformed tab never loosens. On the other hand, when it becomes necessary to replace the bracelet with a fresh bracelet, this can be done by bending out the deformed tab with a tool to release the bracelet pin. After the new bracelet is inserted, one again bends down the tab to lock the bracelet pin. While one can do this only a limited number of times without breaking off the tab, the life of a typical watch is limited, and in the course of this life, one has few occasions to replace the bracelet.

While there has been shown and described a preferred embodiment of an integrated watch case and bracelet assembly in accordance with the invention, it will be appreciated that many changes and modifications may be made therein without, however, departing from the essential spirit thereof. Thus while the pin and keyway in the assembly are shown as having a circular cross section, they may have other cross-sectional shapes, as long as matching shapes are provided to permit the split pin to slide into the keyway. Also, instead of a metal bracelet, the components, including the tail pins, may be molded or otherwise fabricated of synthetic plastic material such as PVC.

I claim:

1. A watch case and bracelet assembly comprising:

A. a metal case for accommodating a watch movement, said case having straight ends each provided with a longitudinal keyway defined by a pair of parallel ridges, one of which has a midpoint gap therein occupied by a tab which is formed of deformable metal and normally projects outwardly above said keyway; and B. a bracelet formed of two components which when joined together at their leading ends encircle the wrist of the wearer, the tail end of each component terminating in a split pin which is slidable into the keyway at the complementary end of the case, said split pin having a midspace between the half pieces thereof which when the pin is in place lies in registration with said gap, whereby when the deformable tab is then bent downwardly into said midspace, it acts to lock the component to the case.

2. An assembly as set forth in claim 1, wherein the leading ends of the components are provided with coupling elements.

3. An assembly as set forth in claim 1, wherein said case has a generally octagonal shape and a well to receive said movement.

4. An assembly as set forth in claim 1, wherein said pin and said keyway both have circular cross sections.

5. An assembly as set forth in claim 1, wherein said bracelet components are metallic and said pins are welded to the tail ends.

* * * * *